United States Patent [19]

Kozak

[11] 4,333,557

[45] Jun. 8, 1982

[54] SOLID STATE SLUG REJECTOR

[76] Inventor: George M. Kozak, 58 Second St., Old Bridge, N.J. 08857

[21] Appl. No.: 123,385

[22] Filed: Feb. 21, 1980

[51] Int. Cl.[3] ..... G07F 3/02

[52] U.S. Cl. ..... 194/97 A; 73/163; 194/99

[58] Field of Search ..... 194/97 R, 97 A, 99, 194/100 A; 73/163; 209/587, 598

[56] References Cited

U.S. PATENT DOCUMENTS

| | | | |
|---|---|---|---|
| 3,921,003 | 11/1975 | Greene | 194/97 A X |
| 4,089,400 | 5/1978 | Gregory, Jr. | 194/99 X |
| 4,172,222 | 10/1979 | Eglise | 194/97 A X |

*Primary Examiner*—Robert J. Spar
*Assistant Examiner*—Edward M. Wacyra
*Attorney, Agent, or Firm*—Stoll & Stoll

[57] ABSTRACT

For use in connection with coin-operated vending machines or the like having a coin lock-out coil or solenoid which accepts or rejects coins depending on whether the sole solenoid is energized or de-energized, a detector circuit comprising electromagnetic beam emitters, electromagnetic beam sensors and circuits for interpreting the received signal and determining whether the coin lock-out solenoid is to be energized, thereby accepting a coin, or de-energized, thereby rejecting a coin. The emitter is directed toward an incoming coin slot with the moving coin reflecting the beam in a particular pulsed sequence depending upon the surface characteristics and contours of the coin. The beam sensor is so located as to pick up the pulsed reflected beam from the surface of the coin, which reflections are amplified, timed and counted, and analyzed to accept or reject the coin through energizing or de-energizing the coin lock-out solenoid.

3 Claims, 10 Drawing Figures

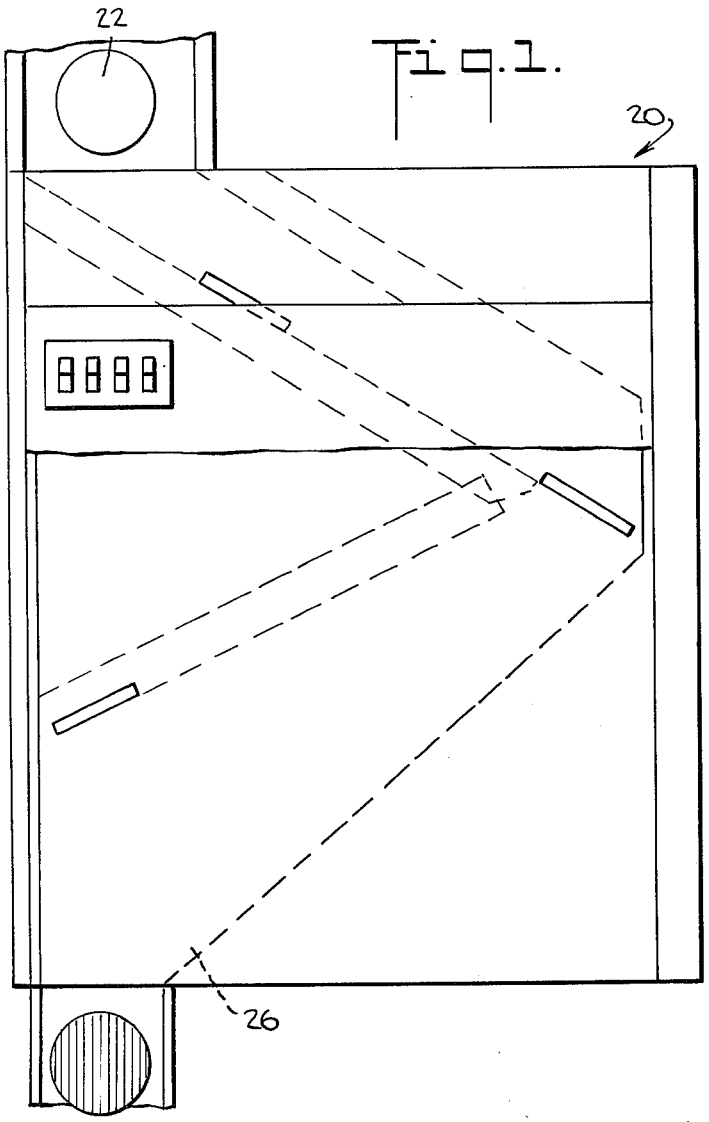
Fig. 1.
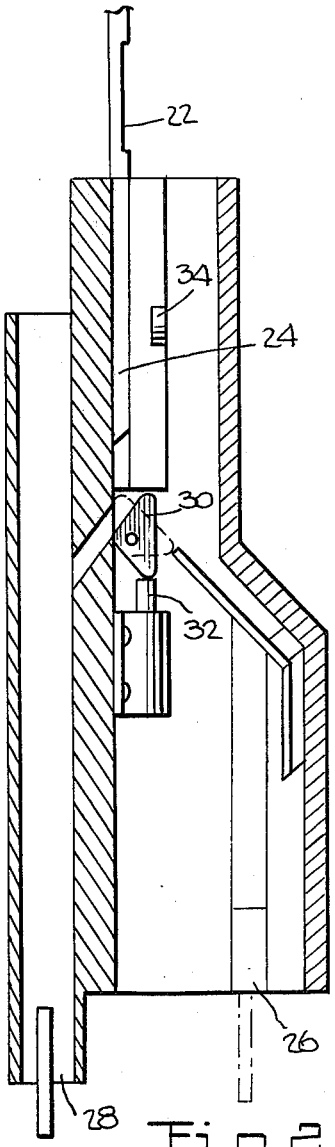
Fig. 2.
Fig. 7.
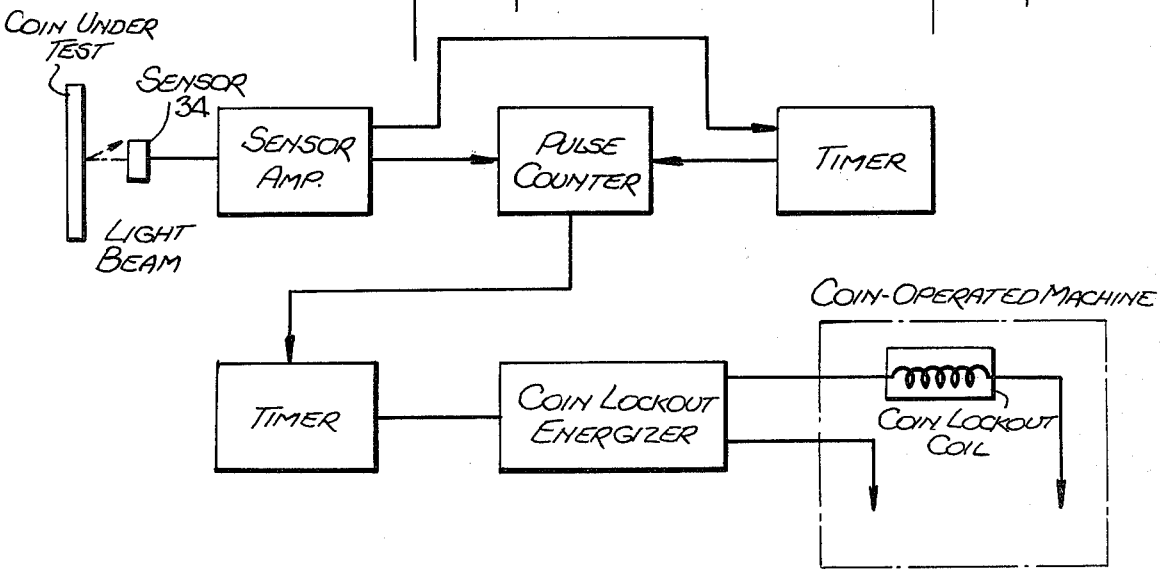

36
22
24
34
30
32

36
34

36a
34
34
36

+5V
U2
U3
R8
U1
U5
U4
J
Counter Reset Pulse
Q1
R2
IR LIGHT IN 37
34
IR LIGHT OUT 35
32
R9
SW2

SOLID STATE SLUG REJECTOR

REFERENCE TO RELATED DOCUMENT

Reference is made to Disclosure Document No. 75,255, filed Oct. 25, 1978, with respect to the present invention.

BACKGROUND OF THE INVENTION

Conventional coin-operated mechanisms, such as vending and gambling machines frequently have simplified slug detector mechanisms such as magnetic means to detect slugs made of ferrous material as opposed to coins which are generally made of non-ferrous material, as well as size control means which attempt to distinguish between the different size coins of different denominations. Such mechanisms frequently have coin lock-out mechanisms which either accept or reject coins inserted into the mechanism. For example, with a solenoid-actuated lock-out, an energized solenoid will allow a coin to be accepted, while a de-energized solenoid will reject the coin, so that, by way of illustration, when the machine is unplugged and inoperative, coins are rejected and returned to the customer. In general, however, it has been exceedingly difficult to consistently detect and reject a non-ferrous "slug" which is the same size as the coin denomination intended for the machine.

SUMMARY OF THE INVENTION

Briefly, and not by way of limitation, the present invention provides a slug-detection and rejector system which may be added simply and economically to existing coin-operated mechanisms having solenoid-actuated lock-out devices. Alternatively, the invention may be applied to coin mechanisms having no coin lock-out solenoids by addition of such lock-out devices.

In a preferred embodiment, an incident beam of electromagnetic energy is reflected off the face of a moving coin with the reflections being scattered or interrupted in accordance with the surface contours of the coin. In an extreme case, such as a slug with a polished surface, the reflected beam is neither dispersed nor interrupted. On the other hand, the intricately engraved surface contour of a genuine coin would interrupt and deflect the beam at least a pre-determined number of times as the coin passes the incident beam, while most known slugs would interrupt and deflect the beam fewer times. The detected reflection will consist of an interrupted or non-interrupted signal in accordance with the surface contour of the reflecting coin and this series of detected pulses is fed to an interpreting circuit. The circuit includes two timing features and a counter feature.

A first time interval begins with the first detected beam scattering and the counter is pulsed at the same time. The pulsed detected signal activates the counter once per each pulse during the first time interval. If sufficient pulses are counted during the first time interval (the number of pulses being pre-selected in accordance with coin denomination), a second time interval begins. This interval activates the coin lock-out and keeps it activated until the coin is fully accepted into the machine.

The first timed interval will not permit any second coin, or slug, passing rapidly together with the first coin, to be accepted on the basis of the pulse-analysis of the first coin because it resets the counter after one coin passes the sensor.

BRIEF DESCRIPTION OF THE DRAWING

FIG. 1 is a front view, partly in phantom, of the coin insert slot and path of a conventional vending machine.

FIG. 2 is a side view of the mechanism of coin 1, in cross-section, showing the coin lock-out solenoid and lock-out deflector.

FIG. 7 is a schematic sequence of operation of the present invention.

DESCRIPTION OF A PREFERRED EMBODIMENT

Figures 3, 4, 5, 6:
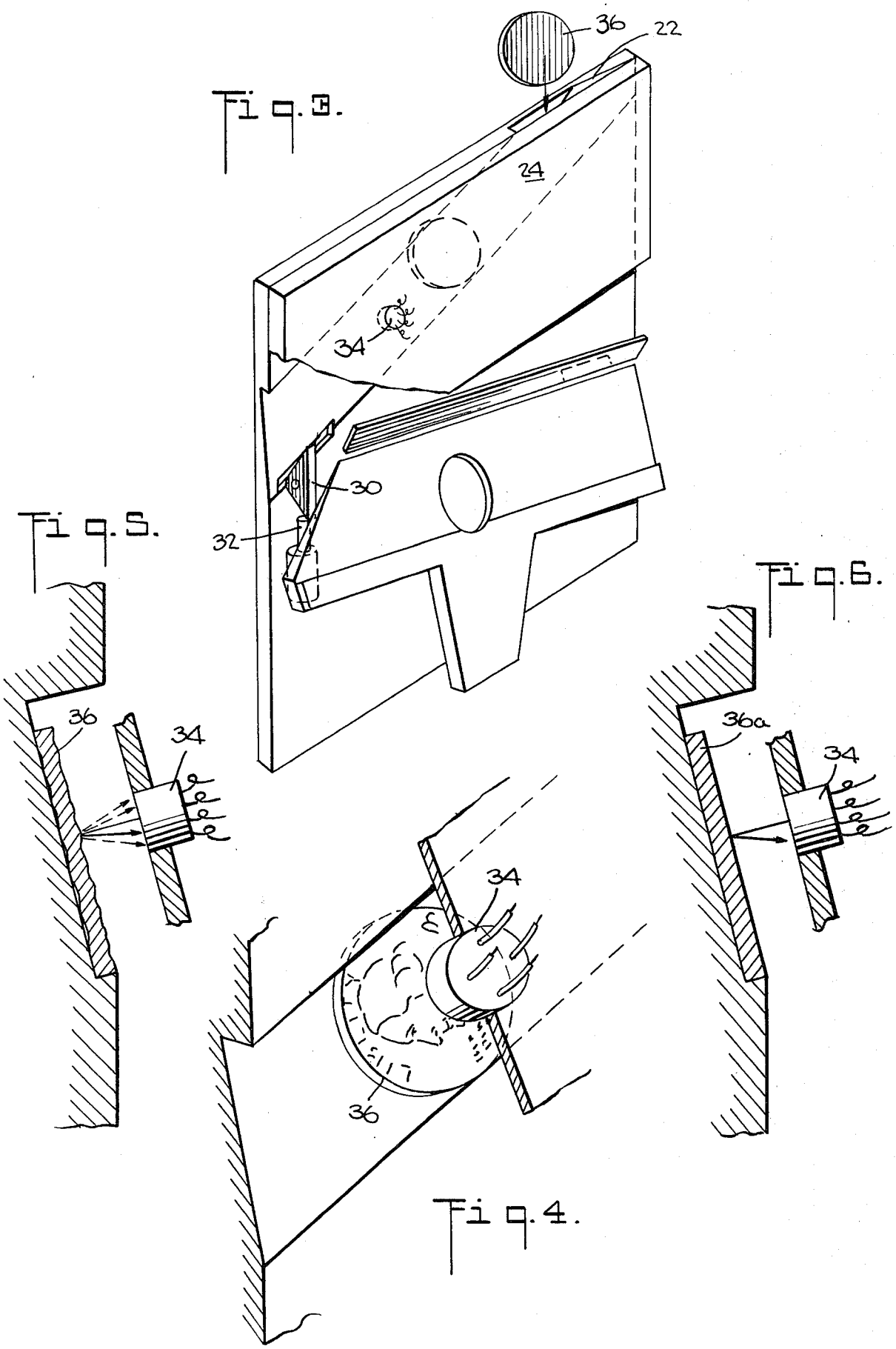
FIG. 3 is a rear perspective view of the mechanism of FIG. 1, showing the path of an inserted coin, the electromagnetic beam detector, and the conventional lock-out mechanism.
FIG. 4 is an enlarged view of a genuine coin shown passing the electromagnetic beam.
FIG. 5 is a cross-sectional view of the coin slot at the location of the electromagnetic beam detector, schematically showing pulsed reflected beams from the irregular surface of a moving genuine coin.
FIG. 6 is a view similar to that of FIG. 5, but schematically showing non-pulsed reflection of the electromagnetic beam by a moving bogus coin.

With reference to the drawing, a coin activated mechanism 20 comprises a coin insert slot 22, and incoming coin chute 24. The coin path between incoming chute 24 and either of reject chute 26 or accept chute 28 is controlled by lock-out deflector plate 30 activated by a lock-out solenoid 32.

Mounted in the path of the coin in incoming coin chute 24 is an emitter/detector 34 which in the preferred embodiment comprises an infrared light-emitting diode 34 and a light-sensing phototransistor 37 mounted in a single package such that light emitted from the diode 35 will be received by phototransistor 37 only if a reflective object is placed directly in front of emitter/detector 34. Such a reflective object is the incoming coin 36 or slug 36*a*. If an authentic coin 36 is involved, with a relatively intricately engraved surface contour, the infrared beam will be scattered and reflected many times as the coin passes emitter/detector 34 resulting in a pulsed signal received by phototransistor 37. The pulses received by phototransistor 37 are fed to an amplifying transistor Q1, the sensitivity or amplification factor of which is modified by resistor R2. The pulse is then sent to pin 14 of a decade counter U1 as well as to pin 2 of a timer U2. The initial such pulse from a moving coin activates timer U2 to run a given first time interval T1. During such time interval T1, the various pulses from the coin reflection are supplied to pin 14 of decade counter U1 and the decade counter counts the number of pulses or the corresponding number of times the infrared beam is scattered. After interval T1 expires, timer U2 resets the counter readying it for the next coin.

If during time interval T1 a number of pulses greater than a pre-selected number is attained, the BCD to decimal decoder U5 would so indicate by a low logic pulse at the pin of U5 corresponding to the pre-selected number desired (see Table I). For example, if a 25¢ coin will pulse the counter a minimum of 8 times, regardless of its orientation as it travels past detector 28 and within time interval T1, the pre-selected number would be 8 to distinguish a genuine quarter from any slug which would provide less than 8 pulses. A count of 8 would be indicated on BCD to decimal decoder U5 by a low logic pulse at its pin 1. This low pulse is applied to pin 2 of timer U3, starting the timer, activating the coin lock-out coil and accepting the coin. If the pulse count is less than 8, no low pulse would be applied to pin 2 and the lock-out coil would not be activated, remaining in its rejecting position, thereby rejecting the slug.

At the conclusion of the first time interval T1, the counter U1 is reset by U2 (regardless of whether or not the coin was genuine) by means of a high pulse applied to pin 13 of an inverter U4 which inverts the high pulse to a low pulse and applies it to pins 2 and 3 of decade counter U1, thereby resetting the counter. Thus, after a preset first time interval T1 for counting, the decade counter is reset. This readies the counter circuit for the introduction of the next coin. Second time interval T2, adjustable by means of a varible resistor R8 to be the time it takes a genuine coin to pass from detector 34, to the means used to accept the coin (lock-out coil 32 and deflector plate 30). If interval T2 was not employed the lock-out coil would pulse momentarily after the coin was deemed genuine, but would not remain on long enough for the coin to move from the verification means (detector 34) to the coin accept means (lock-out deflection plate 30 and lock-out coil 32).

The method of selecting the pre-selected number of pulses is by means of a binary coded decimal (BCD) to decimal decoder U5, the use of which enables the pre-selected number to be adjustable to any number between 0 and 9, both inclusive. It should be noted that in practice the number of pulses will be pre-selected to a number greater than one. Also, if a pulse count higher than 9 is required for verification (as might be the case when dealing with extremely large coins such as silver dollars) additional type 7490 counters could easily be added to the basic circuitry shown, thus enabling the invention to count to as high a number as is necessary to validate the coin.

Assuming the use of a type 7441 BCD to decimal decoder, to activate coin lock-out coil 32 after one pulse, pin 2 of timer U3 is connected to pin 15 of U5 via jumper wire J.

The following table indicates the pin of U5 to which pin 2 of U3 is connected by jumper wire J in order to achieve the indicated pre-selected number of pulses:

TABLE I

| Pre-selected Number of Pulses | Pin of U5 |
|---|---|
| 1 | 15 |
| 2 | 8 |
| 3 | 9 |
| 4 | 13 |
| 5 | 14 |
| 6 | 11 |
| 7 | 10 |
| 8 | 1 |
| 9 | 2 |

Thus, the pre-selected number of pulses is determined through the selection of the pin of U5 to which jumper wire J is connected. This corresponds to the minimum number of pulses needed to detect the particular coin being sent down incoming chute 24.

If the desired number of pulses are reached within first time interval T1, a high pulse from decade counter U1 is applied to inverter U4 which inverts it to a low logic level thereby starting the timer U3. Pin 3 of timer U3 goes to a high logic level and activates coin lock-out coil 32, thereby accepting the coin. After a second time interval T2 elapses, pin 3 of timer U3 returns to a low logic level and the coin lock-out de-energizes. If a bogus coin or slug is introduced, decade counter U1 would not count high enough to pulse timer U3 and, after T1, the counter would automatically reset, readying the circuit for the next coin. The slug would be returned through reject coin chute 26, since the lock-out solenoid 32 was not activated.

Figures 8, 9, 10:
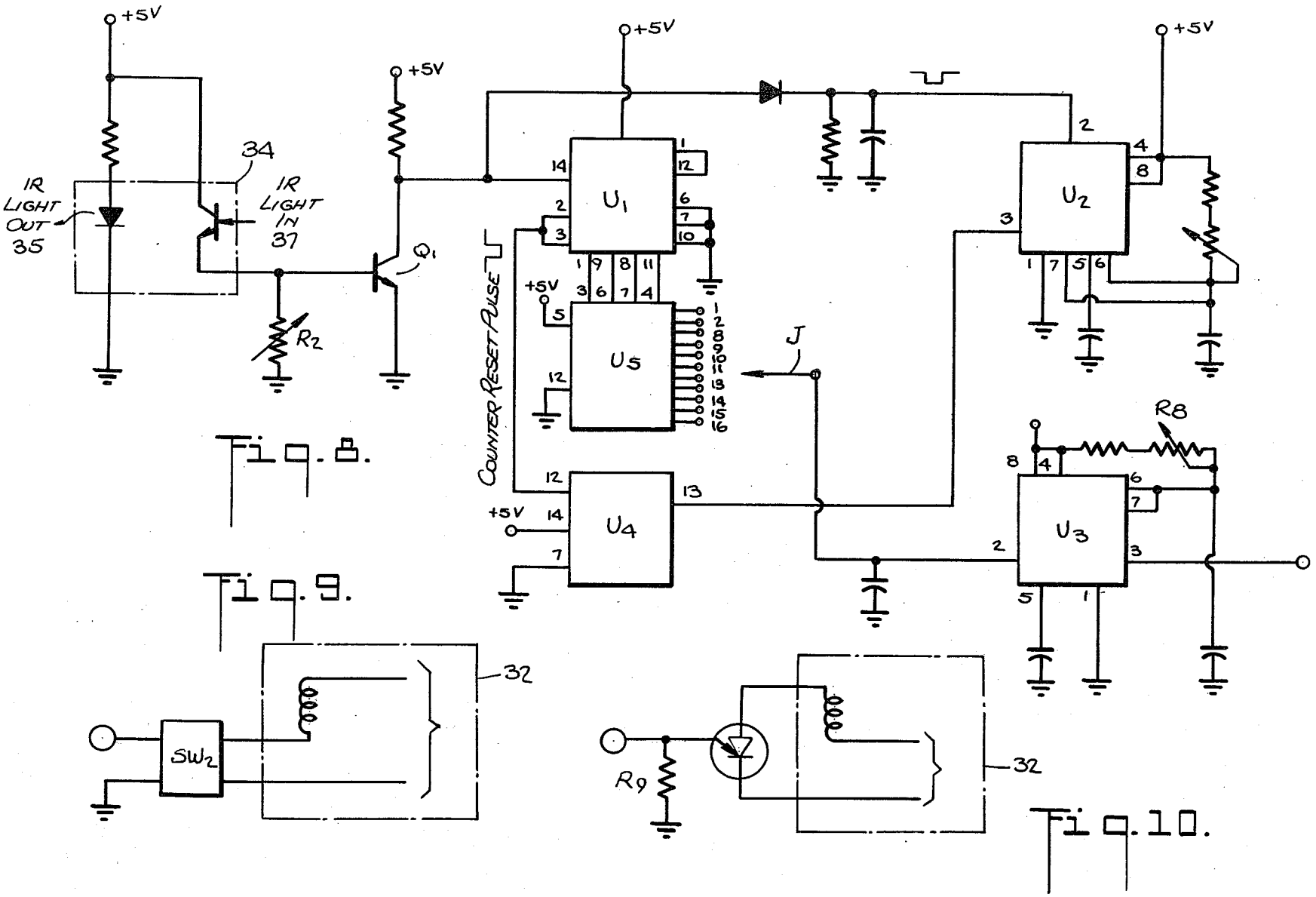
FIG. 8 is a schematic circuit diagram of the present invention.
FIG. 9 is a schematic circuit diagram of an AC activator for the coin lock-out coil.
FIG. 10 is a schematic circuit diagram for a DC activator for the coin lock-out coil.

The case of an AC operated lock-out coil 32 (see FIG. 9) SW2 is a sold state AC relay which triggers at 5 volts. A Radio Shack #275-236 or equivalent is suitable.

In the case of a DC operated coin lock-out coil 32 (see FIG. 10), resistor R9 is a ½ watt 1K ohm rating while a Darlington transistor may be a type 2N6044 or equivalent.

In the preferred embodiment, the following circuit elements have the characteristics indicated in Table II:

TABLE II

| | | |
|---|---|---|
| R1 | = | Resistor 75Ω |
| R2 | = | Resistor Variable, 10KΩ |
| R3 | = | Resistor 1KΩ |
| R4 | = | Resistor 1 Meg.Ω |
| R5 | = | Resistor 10KΩ |
| R6 | = | Variable Resistor 2.5 Meg.Ω |
| R7 | = | Resistor 10KΩ |
| R8 | = | Variable Resistor 2.5 Meg.Ω |
| C1 | = | Capacitor, .01μf |
| C2,C5 | = | 10μf electrolytic |
| C3 | = | Capacitor, .1μf |
| C4 | = | Capacitor, .1μf |
| D1 | = | Diode 1N4004 or equivalent |
| Q1 | = | NPN Transistor 2N2222 or equivalent |
| Q2 | = | NPN Darlington Transistor, type 2N6044 or equivalent |
| S1 | = | Infrared emitter and detector, Fairchild FTK0042 or equivalent |
| SW2 | = | Solid State AC power relay, Radio Shack #275-236 or equivalent |
| U1 | = | 7490 Decade Counter |
| U2,U3 | = | 555 IC Timer |
| U4 | = | 7404 Hex Inverter |
| U5 | = | 7441 BCD to Decimal Decoder |

While the foregoing is illustrative of a preferred embodiment of the invention, it is clear that other embodiments may be had within the scope hereof. For example, while an infrared LED (light-emitting diode) and phototransistor are utilized for the emitter and detector, other emitters and detectors may be utilized which pulse either electromagnetic energy or sound waves such that reflections, both scattered and direct may easily be turned into amplified pulses and counted. Moreover, while a particular circuit has been indicated, it is clear that other circuits may be utilized to achieve the same results.

What is claimed is:

1. A slug detection and rejection system for distinguishing between genuine and bogus coins, comprising:

a. an electromagnetic transmitter;

b. a receiver adapted and located to receive pulsed electromagnetic energy reflected from the surface contours of a face of a moving coin; and c. pulse-counting electrical circuit means, said pulse counting electrical circuit means distinguishing between a genuine and a bogus coin by counting the number of received pulses, comparing said number with a pre-selected number and activating a coin lock-out mechanism accordingly.

2. A slug detection and rejection system in accordance with claim 1, wherein said pulse counting electrical circuit means comprises:

a. pulse counter and comparator circuit means;

b. first timing means and c. coin lock-out energizing means d. whereby said pulse counter and comparator circuit means counts the number of reflected pulses during a first time interval as determined by said first timing means and compares said number with a pre-selected number, said coin lock-out energizer being energized to accept a coin in the event the pre-selected number is achieved during said first time interval.

3. A slug detection and rejection system in accordance with claim 2, additionally comprising:

a. second timing means, said second timing means, activated in the event the pre-selected number of pulses is counted during said first time interval, to maintain said coin lock-out mechanism in its accept condition for a second time interval, b. said second time interval being the time necessary for a coin to move from the detector means to past said coin lock-out mechanism.

* * * * *